US009371691B2

(12) United States Patent
Yu et al.

(10) Patent No.: US 9,371,691 B2
(45) Date of Patent: Jun. 21, 2016

(54) MOTORIZED WINDOW SHADE

(71) Applicant: Teh Yor Co., Ltd., Taipei (TW)

(72) Inventors: Fu-Lai Yu, New Taipei (TW); Chin-Tien Huang, New Taipei (TW); Chien-Fong Huang, City of Industry, CA (US)

(73) Assignee: TEH YOR CO., LTD. (TW)

( * ) Notice: Subject to any disclaimer, the term of this patent is extended or adjusted under 35 U.S.C. 154(b) by 0 days.

(21) Appl. No.: 14/249,378

(22) Filed: Apr. 10, 2014

(65) Prior Publication Data

US 2014/0311686 A1 Oct. 23, 2014

Related U.S. Application Data

(60) Provisional application No. 61/812,744, filed on Apr. 17, 2013, provisional application No. 61/862,594, filed on Aug. 6, 2013.

(51) Int. Cl.

| | |
|---|---|
| ***E06B 9/32*** | (2006.01) |
| ***E06B 9/68*** | (2006.01) |
| ***E06B 9/26*** | (2006.01) |

(Continued)

(52) U.S. Cl.

CPC ... *E06B 9/68* (2013.01); *E06B 9/26* (2013.01); *E06B 9/32* (2013.01); *E06B 9/322* (2013.01); *E06B 9/323* (2013.01); *E06B 2009/6809* (2013.01)

(58) Field of Classification Search

CPC ..... E06B 9/68; E06B 9/26; E06B 9/32; E06B 9/322; E06B 9/323; E06B 2009/6809

USPC ..... 160/168.1 R; 5/509.1

See application file for complete search history.

(56) References Cited

U.S. PATENT DOCUMENTS

| | | | | |
|---|---|---|---|---|
| 3,310,099 | A * | 3/1967 | Hunter et al. | 160/171 |
| 3,711,664 | A * | 1/1973 | Benoit et al. | 200/5 R |
| 4,635,903 | A * | 1/1987 | Broyden | B66D 3/26 174/DIG. 12 |

(Continued)

FOREIGN PATENT DOCUMENTS

| | | |
|---|---|---|
| TW | 138559 | 7/1990 |
| WO | 2010011751 A1 | 1/2010 |

OTHER PUBLICATIONS

Official Action from China Patent Application No. 201410141612.2 dated Jul. 9, 2015.

(Continued)

*Primary Examiner* — Katherine Mitchell
*Assistant Examiner* — Abe Massad
(74) *Attorney, Agent, or Firm* — David I. Roche; Baker & McKenzie LLP

(57) ABSTRACT

A motorized window shade includes a head rail, a bottom part suspended from the head rail, and a covering structure arranged between the head rail and the bottom part. An electric motor is arranged in the head rail and is operable to drive a vertical displacement of the bottom part. The window shade further includes a control interface electrically connected with the electric motor, and suspended outward from the head rail. The control interface is operable to control rotation of the electric motor for raising and lowering the bottom part. An elongated tube may further be disposed outside the head rail. The elongated tube has an upper end connected with the head rail, and the control interface is assembled adjacent to a lower end of the elongated tube.

22 Claims, 11 Drawing Sheets

(51) Int. Cl.
*E06B 9/322* (2006.01)
*E06B 9/323* (2006.01)

(56) References Cited

U.S. PATENT DOCUMENTS 5,472,035 A * 12/1995 Biba et al. ..... 160/168.1 R
6,060,852 A * 5/2000 Domel et al. ..... 318/480
6,396,224 B1 * 5/2002 Luff et al. ..... 318/16
6,516,860 B1 * 2/2003 Weaver et al. ..... 160/168.1 R
7,504,602 B2 * 3/2009 Rohr ..... B66C 13/40 200/298

OTHER PUBLICATIONS

Official Action from Taiwan Patent Application No. 103113290 dated Jun. 16, 2015.

* cited by examiner

MOTORIZED WINDOW SHADE

CROSS-REFERENCE TO RELATED APPLICATIONS

This application respectively claims priority to both U.S. Provisional Patent Application No. 61/812,744 filed on Apr. 17, 2013, and to U.S. Provisional Patent Application No. 61/862,594 filed on Aug. 6, 2013, which are incorporated herein by reference.

BACKGROUND

1. Field of the Invention

The present inventions relate to motorized window shades.

2. Description of the Related Art

Certain window shades may be provided with a motor that allows to conveniently raise and lower the shade. The motor and its power source may be disposed in a support structure mounted at a top of a window frame, and a remote controller may be provided to wirelessly control the operation of the motor. This type of motorized window shades is suitable for relatively higher end products, but not for lower end products owing to a higher manufacture cost.

Therefore, there is a need for a motorized window shade that is convenient to operate, more economical to fabricate, and address at least the foregoing issues.

SUMMARY

The present application describes a motorized window shade having a motorized actuating mechanism, and a control interface suspended outward and operable to control the operation of the actuating mechanism.

In one embodiment, the motorized window shade includes a head rail, a bottom part suspended from the head rail, and a covering structure arranged between the head rail and the bottom part. A winding unit is arranged in the head rail and operatively connected with the bottom part, the winding unit rotating for driving a vertical displacement of the bottom part relative to the head rail. An electric motor is arranged in the head rail and is operable to drive rotation of the winding unit. The window shade further includes a control interface electrically connected with the electric motor, and an elongated tube disposed outside the head rail. The control interface is operable to control rotation of the electric motor in a first direction for raising the bottom part, and in a second direction for lowering the bottom part. The elongated tube has a first and a second end opposite to each other, the first end being pivotally connected with the head rail, and the control interface being assembled adjacent to the second end of the elongated tube.

In another embodiment, the motorized window shade includes a motorized actuating mechanism, a control interface, and an elongated tube disposed outside the head rail. The actuating mechanism includes an electric motor operable to drive a vertical displacement of the bottom part relative to the head rail to collapse and expand the covering structure. The control interface is electrically connected with the electric motor via a cable assembly, the control interface being operable to control rotation of the electric motor in a first direction for raising the bottom part, and in a second direction for lowering the bottom part. The elongated tube has a first and a second end opposite to each other, the first end being connected with the head rail, the control interface being suspended at the second end of the elongated tube, and the cable assembly being routed through an interior of the elongated tube.

DETAILED DESCRIPTION OF THE EMBODIMENTS

Figure 1:
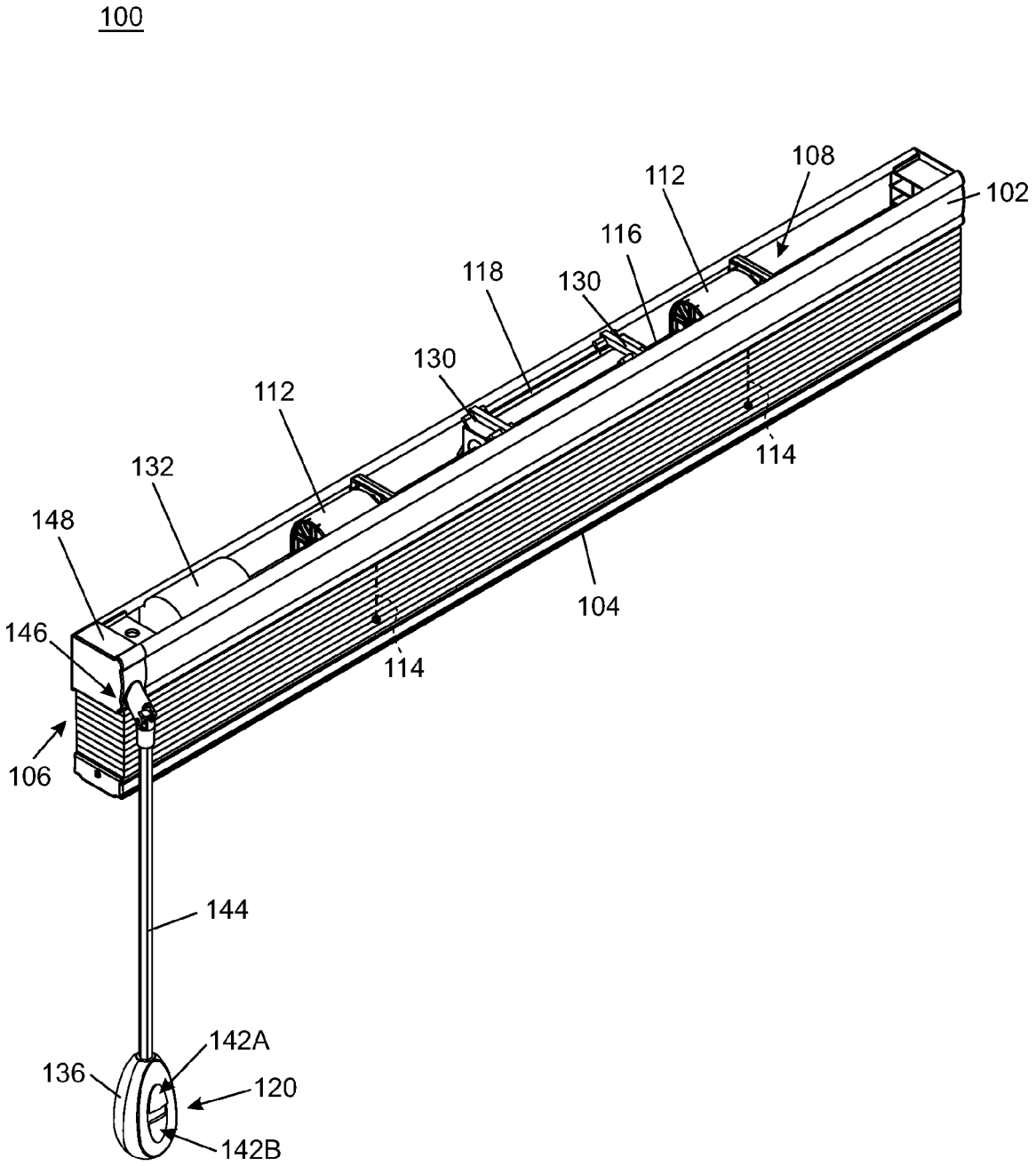
FIG. 1 is a perspective view illustrating an embodiment of a motorized window shade.

FIG. 1 is a perspective view illustrating one embodiment of a motorized window shade 100. The window shade 100 can include a head rail 102, a bottom part 104, and a covering structure 106 disposed between the head rail 102 and the bottom part 104. The covering structure 106 can have an upper end arranged adjacent to the head rail 102, and a lower end arranged adjacent to the bottom part 104. The bottom part 104 may be formed as an elongated rail or a weight element. In one embodiment, the covering structure 106 can be a honeycomb structure made of a fabric material, and include a plurality of cells. The honeycomb structure can have upper and lower ends respectively affixed with the head rail 102 and the bottom part 104. In other embodiments, the covering structure 106 may be formed by a plurality of slats suspended from the head rail 102.

The window shade 100 can also include a motorized actuating mechanism 108 operable to raise and lower the bottom part 104 to collapse and expand the covering structure 106, and a control interface 120 operatively connected with the actuating mechanism 108. The actuating mechanism 108 can include a plurality of winding units 112, suspension cords 114 respectively associated with the winding units 112, a rotary axle 116 and an electric motor 118. The control interface 120 can be electrically connected with the electric motor 118, and can be operable to control the operation of the electric motor 118 to collapse and expand the covering structure 106.

Figure 2:
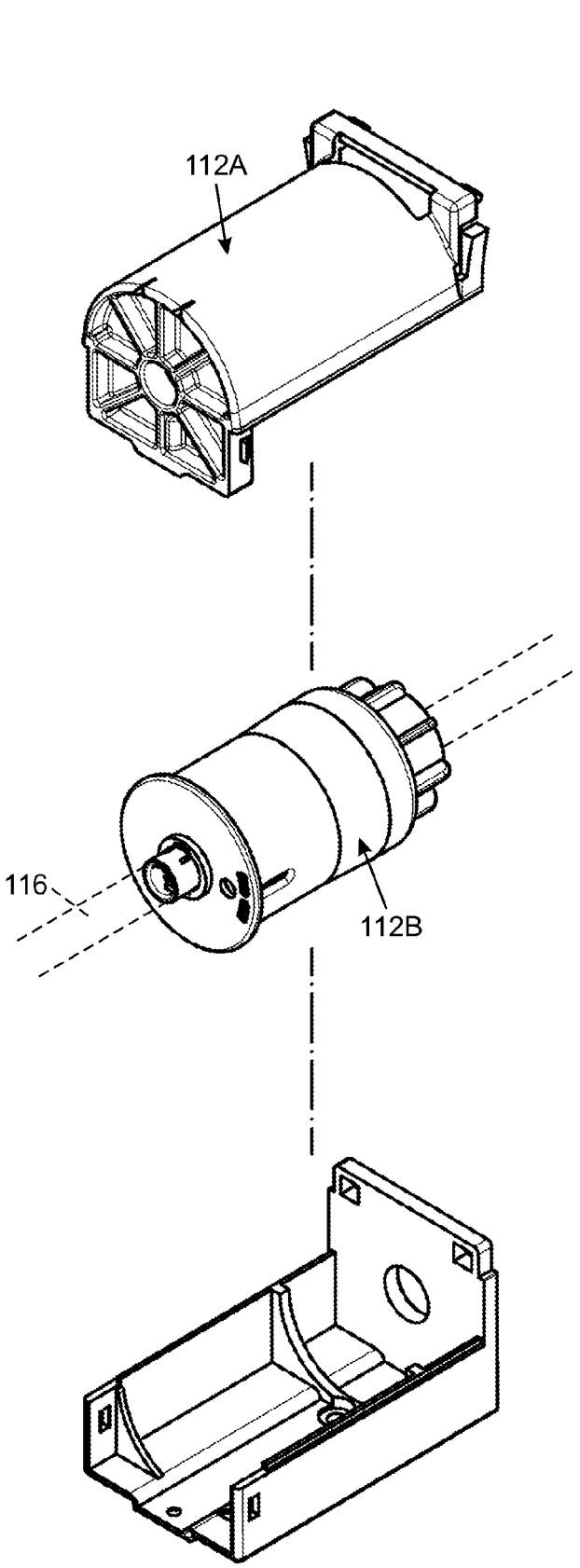
FIG. 2 is a schematic view illustrating the construction of a winding unit used in the motorized window shade.
Figure 3:
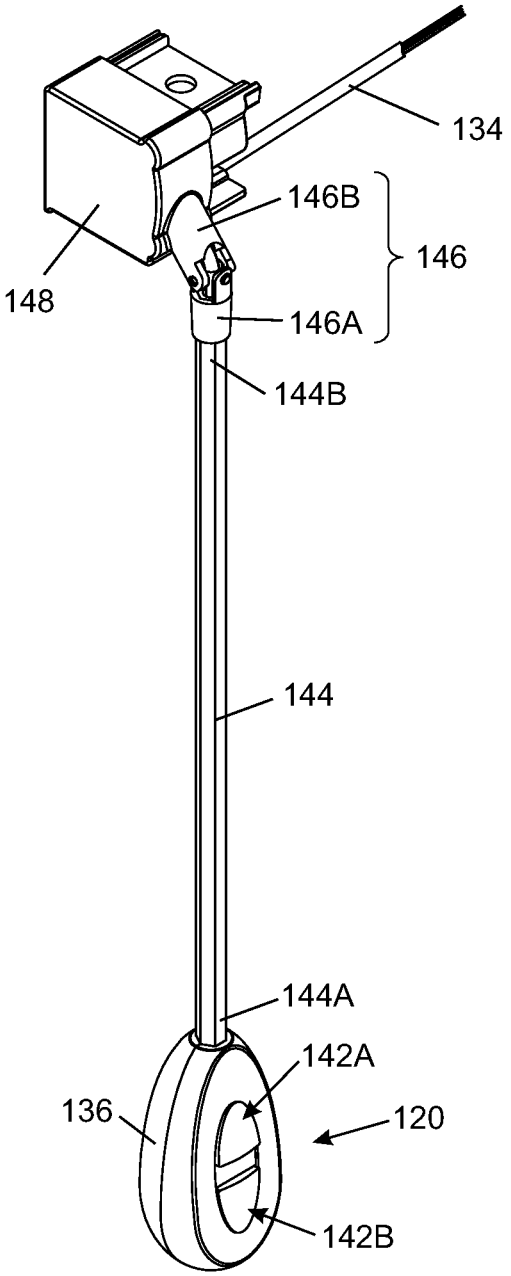
FIG. 3 is a schematic view illustrating the assembly of a control interface used in the motorized window shade.
Figure 4:
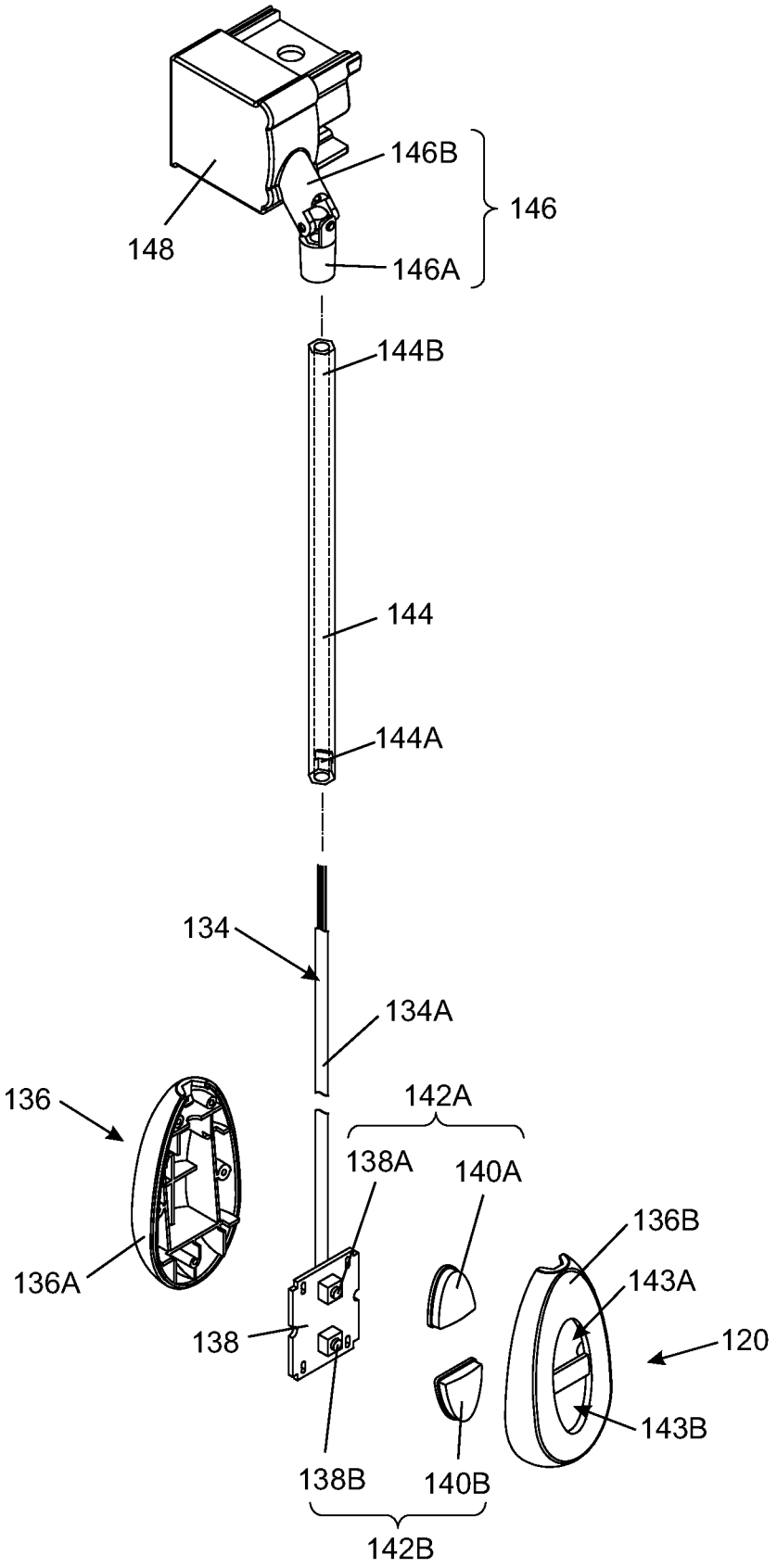
FIG. 4 is an exploded view of the assembly shown in FIG. 3.
Figures 5, 6:
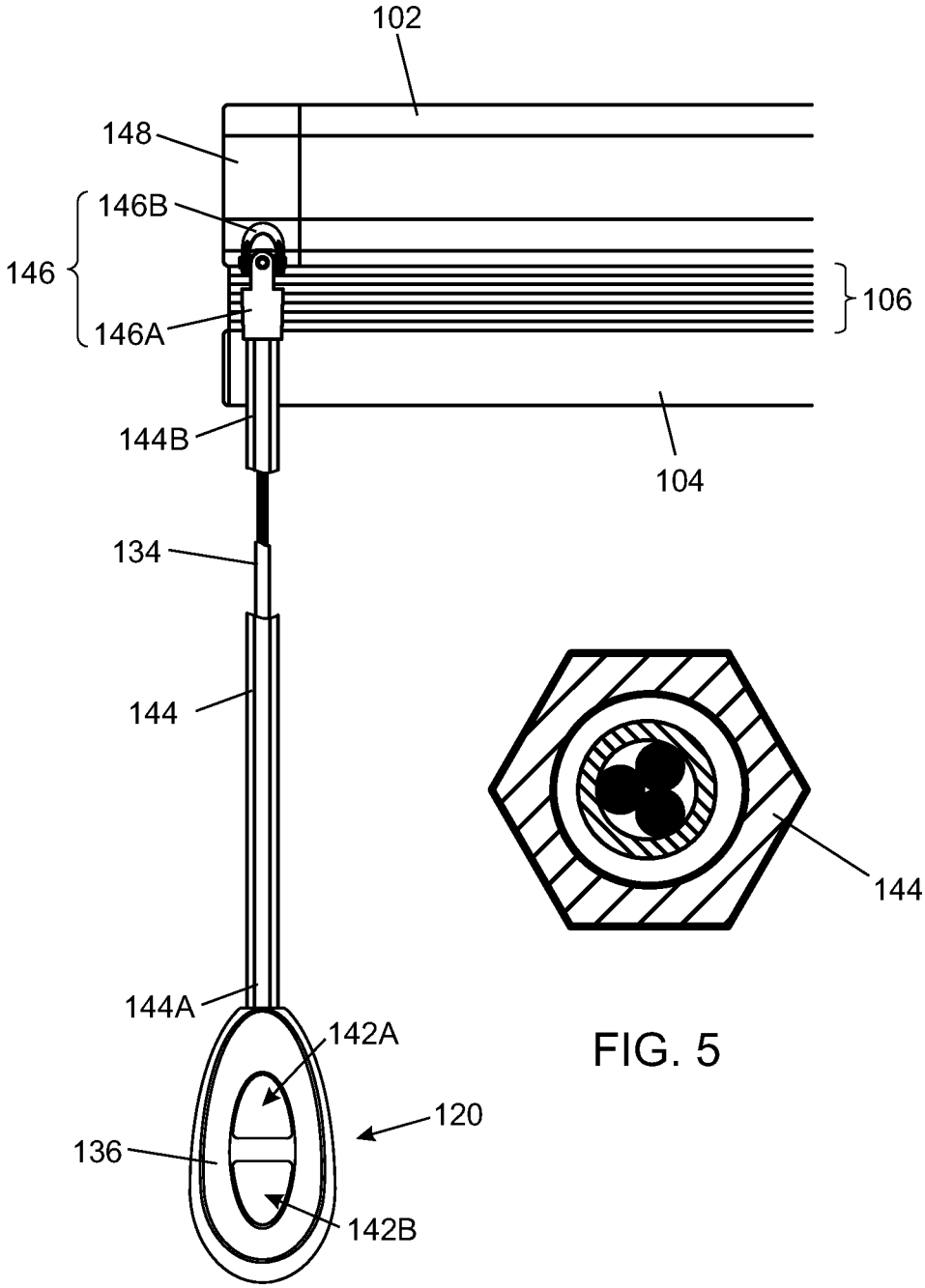
FIG. 5 is a cross-sectional view of an elongated tube assembled adjacent to the control interface.
FIG. 6 is a schematic view illustrating a portion of the motorized window shade including the control interface and the elongated tube.

The winding units 112 can be assembled in the head rail 102 at spaced-apart positions, and can be assembled coaxially about the rotary axle 116. FIG. 2 is a schematic view illustrating the construction of the winding unit 112. The winding unit 112 can exemplary include a casing 112A, and a drum 112B pivotally assembled in the casing 112A and assembled with the rotary axle 116. The winding units 112 thereby can be rotationally coupled with the rotary axle 116.

Each of the suspension cords 114 can have an upper end connected with the drum 112B of one corresponding winding unit 112, and a lower end connected with the bottom part 104. The bottom part 104 can be thereby suspended vertically below the head rail 102. The suspension cords 114 can pass through holes formed in the covering structure 106.

The rotary axle 116 can be assembled through the drums 112B of the winding units 112, so that the drums 112B of the winding units 112 and the rotary axle 116 can rotate in unison.

The electric motor 118 can be assembled in the head rail 102 via a mount fixture. In one embodiment, the mount fixture can include two brackets 130 affixed in the head rail 102. An outer casing of the electric motor 118 can fit with the brackets 130 to be fixedly held in the head rail 102. The electric motor 118 can have an output rotationally coupled with the rotary axle 116, and can drive rotation of the rotary axle 116 in two opposite directions for raising and lowering the bottom part 104.

A power supply 132 can be disposed in the head rail 102 for providing electric power to the electric motor 118. In one embodiment, the power supply 132 can be a battery case The power supply 132 may be arranged at a location spaced apart from the electric motor 118, e.g., one winding unit 112 may be placed between the electric motor 118 and the power supply 132. The power supply 132 may be generally placed at any suitable position in the head rail 102 so as facilitate the installation or replacement. A cable or wiring may electrically connect the power supply 132 with the electric motor 118.

In conjunction with FIG. 1, FIGS. 3-6 are schematic views illustrating the assembly of the control interface 120. The control interface 120 can be electrically connected with the electric motor 118 via a cable assembly 134, which may be formed by one or more cable segments. The cable assembly 134 can convey control signals from the control interface 120 to the electric motor 118, and power signals from the power supply 132 to the control interface 120. The cable assembly 134 can be routed along the head rail 102, and exit the head rail 102 via an opening located close to a lateral end of the head rail 102.

In one embodiment, the control interface 120 can include a housing 136 formed by the assembly of two housing portions 136A and 136B, a circuit board 138 provided with two button pads 138A and 138B, and two button covers 140A and 140B respectively associated with the two button pads 138A and 138B.

The housing 136 can have any shape that facilitates manual grasping. The housing 136 can have an interior in which the circuit board 138 can be assembled. An outer surface of the housing 136 can also include a plurality of openings 143A and 143B through which the button covers 140A and 140B can be restrainedly positioned in alignment with the button pads 138A and 138B of the circuit board 138. The assembly of the button pad 138A with the button cover 140A can form a button 142A of the control interface 120, and the assembly of the button pad 138B with the button cover 140B can form another button 142B of the control interface 120.

The two buttons 142A and 142B can be used to control the operation of the electric motor 118. For example, pushing on the button 142A can activate rotation of the electric motor 118 in a first direction for raising the bottom part 104, and pushing on the button 142B can activate rotation of the electric motor 118 in a second direction for lowering the bottom part 104.

The cable assembly 134 can have a first terminal end electrically connected with the circuit board 138, and a second terminal end arranged in the head rail 102. A segment 134A of the cable assembly 134 extending outside the head rail 102 can be routed through an elongated tube 144 that extends vertically downward from a lateral end portion of the head rail 102. The elongated tube 144 can have a substantially linear shape that substantially encloses the segment 134A of the cable assembly 134 outside the head rail 102. In one embodiment, the elongated tube 144 can be a hollow wand made of a plastic material and having a hollow interior through which is passed the cable assembly 134. The elongated tube 144 can have an end 144A fixedly secured with the control interface 120 (e.g., affixed with the housing 136 of the control interface 120), and another end 144B connected with a pivotal joint 146 disposed outside the head rail 102. The end 144A of the elongated tube 144 can be secured with the housing 136, for example, through a slot and rib engagement. Other possible methods for attaching the end 144A of the elongated tube 144 with the housing 136 of the controller 120 can include welding, gluing, and the like.

Referring to FIGS. 3-6, a lateral end of the head rail 102 may be affixed with an end cap 148. The pivotal joint 146 may include a first joint part 146A that is affixed with the end 144B of the elongated tube 144, and a second joint part 146B that is affixed with the end cap 148 and is pivotally connected with the first joint part 146A. The first and second joint parts 146A and 146B can have tubular shapes for passage of the cable assembly 134.

With the aforementioned construction, the control interface 120 can be suspended below the head rail 102 by the elongated tube 144. The length of the elongated tube 144 can be less than the maximum expansion of the covering structure 106, but sufficiently long so as to allow easy access to the control interface 120 held at the lower end 144A of the elongated tube 144. Moreover, the elongated tube 144 and the control interface 120 can pivot in unison about the pivotal joint 146 relative to the head rail 102 to various angular positions for facilitating grasping and manipulation of the control interface 120. Moreover, the elongated tube 144 can advantageously provide protection for the cable assembly 134 and prevent undesirable lacing or damages thereof.

It will be appreciated that other arrangements for the elongated tube 144 are possible. For example, the elongated tube 144 may be formed as a flexible plastic tube extending vertically downward through which the cable assembly 134 can be arranged. In other embodiments, the pivotal joint 146 may be omitted, and the end 144B of the elongated tube 144 may be a free end that is located outside and adjacent to the head rail 102.

Figure 8:
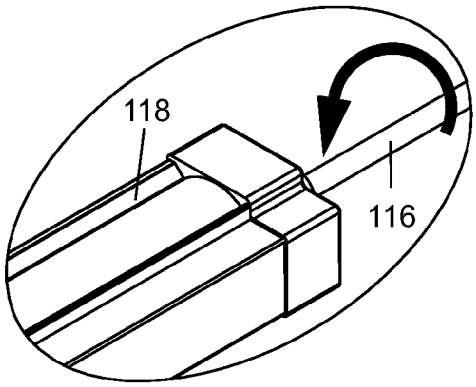
FIG. 8 is an enlarged view illustrating an electric motor driving rotation of a rotary axle for lowering the window shade.
Figure 7:
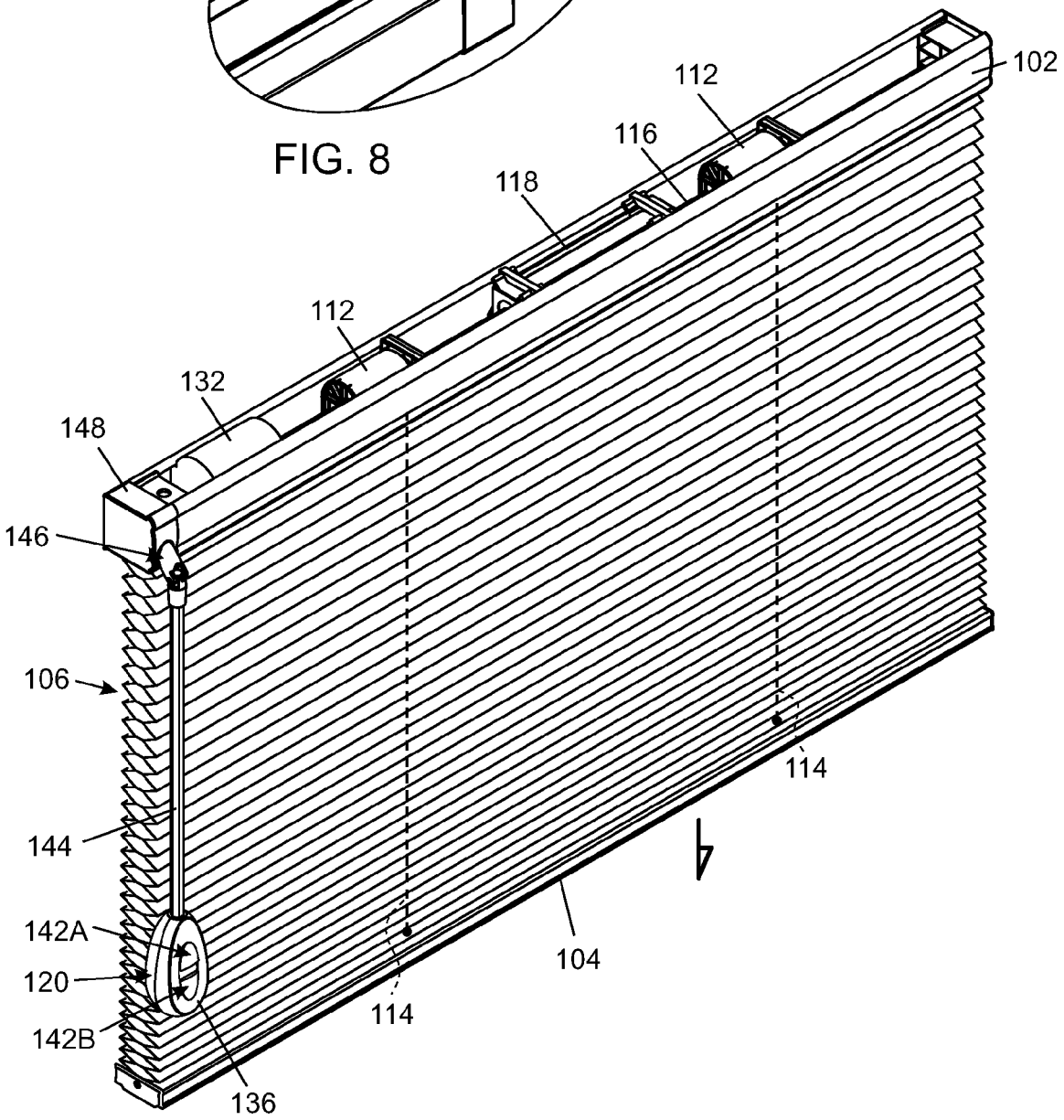
FIG. 7 is a schematic view illustrating exemplary operation for lowering the window shade.
Figure 10:
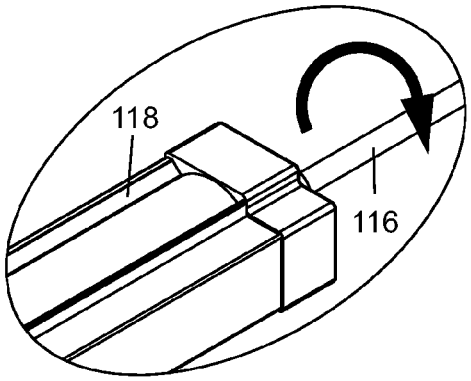
FIG. 10 is an enlarged view illustrating the electric motor driving rotation of the rotary axle for raising the window shade.
Figure 9:
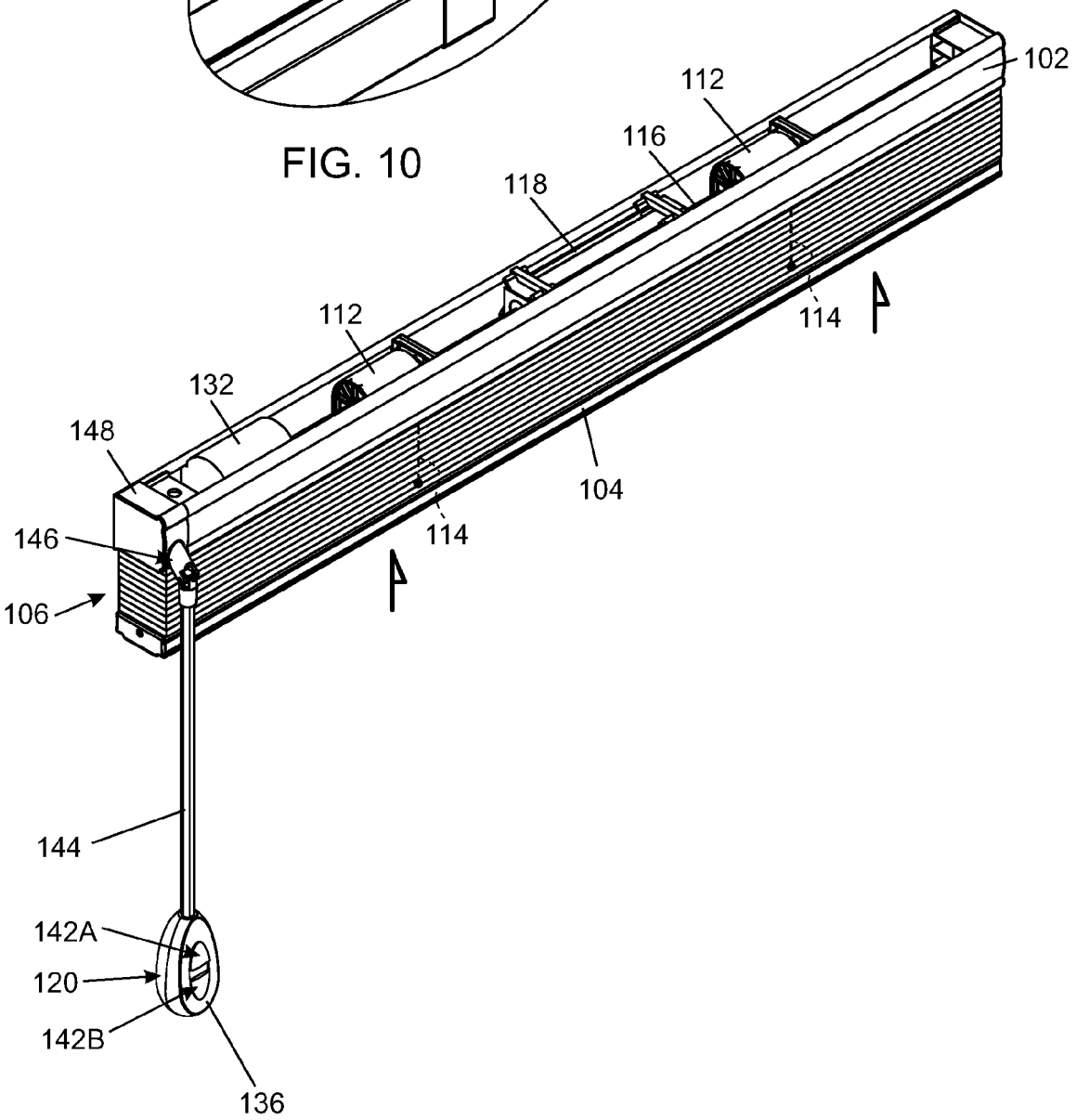
FIG. 9 is a schematic view illustrating exemplary operation for raising the window shade.

In conjunction with FIGS. 1-6, FIGS. 7-10 are schematic views illustrating exemplary operation of the motorized window shade 100. When a user pushes on the button 142B, an electric control signal is transmitted from the control interface 120 along the cable assembly 134 to activate rotation of the electric motor 118, which drives the rotary axle 116 to rotate in the direction for lowering the bottom part 104 (as shown in FIGS. 7 and 8). When a user pushes on the button 142A, another electric control signal is transmitted from the control interface 120 along the cable assembly 134 to activate rotation of the electric motor 118, which drives the rotary axle 116 to rotate in the other direction for raising the bottom part 104 (as shown in FIGS. 9 and 10).

Figure 11:
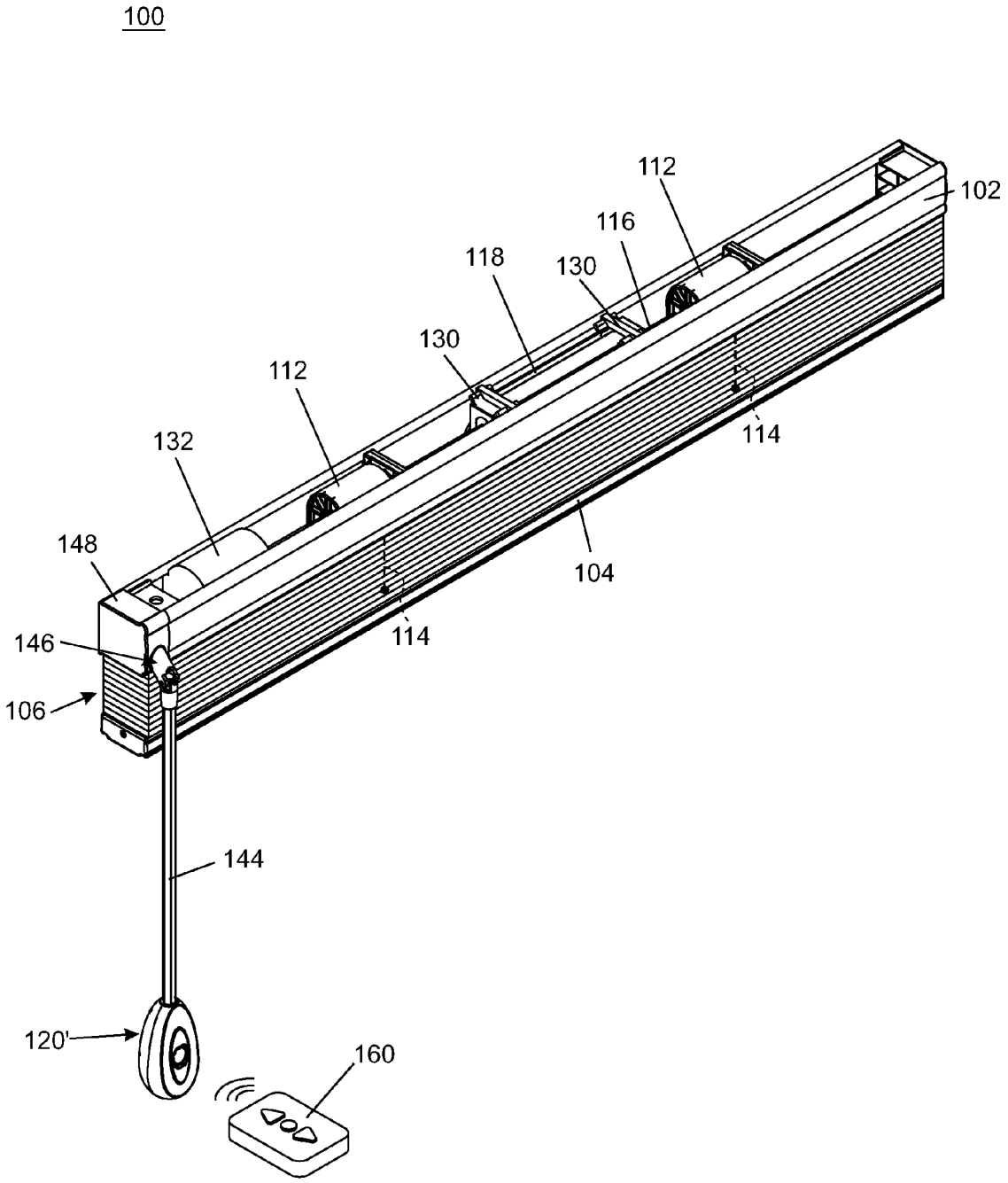
FIG. 11 is a schematic view illustrating another variant embodiment of a motorized window shade including a remote wireless controller.

FIG. 11 is a schematic view illustrating a variant embodiment of the motorized window shade 100. In this embodiment, a remote wireless controller 160 can be further provided in addition to the control interface 120'. The remote wireless controller 160 can include a plurality of buttons, and can wirelessly communicate with a wireless communication interface incorporated in the control interface 120'. Accordingly, the user can operate any of the buttons on the remote wireless controller 160, which can accordingly send a wireless signal (for example, infrared signal) to the control interface 120', which in turn transmits a corresponding electric control signal along the cable assembly 134 to activate rotation of the electric motor 118 to lower or raise the bottom part 104. According to the design's needs, the control interface 120' interacting with the remote wireless controller 160 may or may not have buttons operable by a user to control rotation of the electric motor 118.

Figure 12:
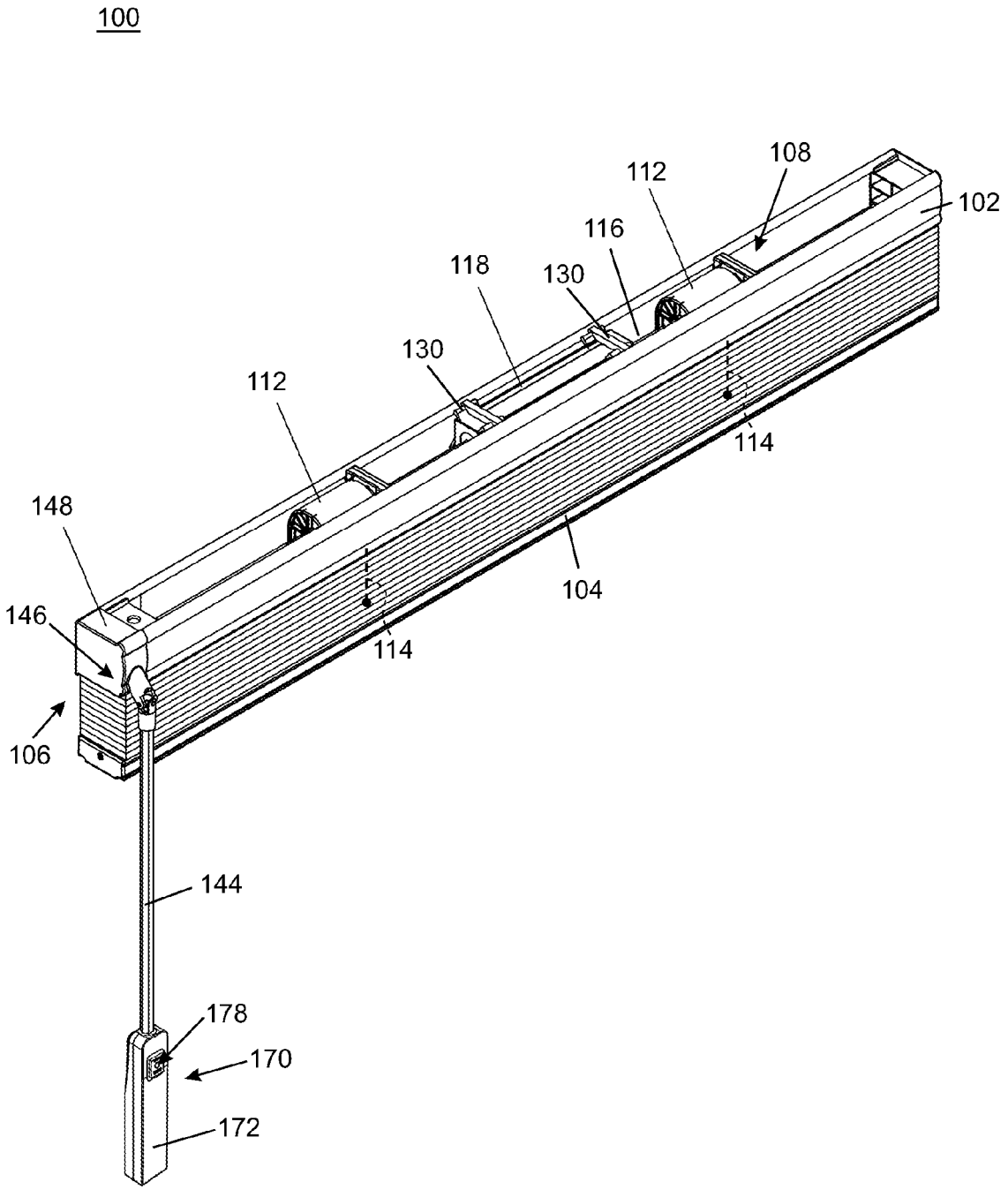
FIG. 12 is a perspective view illustrating another embodiment of a motorized window shade.

FIG. 12 is a schematic views illustrating another variant embodiment in which a control interface 170 may substitute for the control interface 120 previously described. Like previously described, the control interface 170 can be electrically connected with the electric motor 118 via the cable assembly 134 (as better shown in FIG. 13) arranged through the elongated tube 144, and can be suspended from the head rail 102 at the lower end of the elongated tube 144. In this embodiment, however, the head rail 102 includes no power supply 132. Instead, the control interface 170 can be configured to integrate a remote power supply that can provide electric power to the electric motor 118 via the cable assembly 134.

Figure 13:
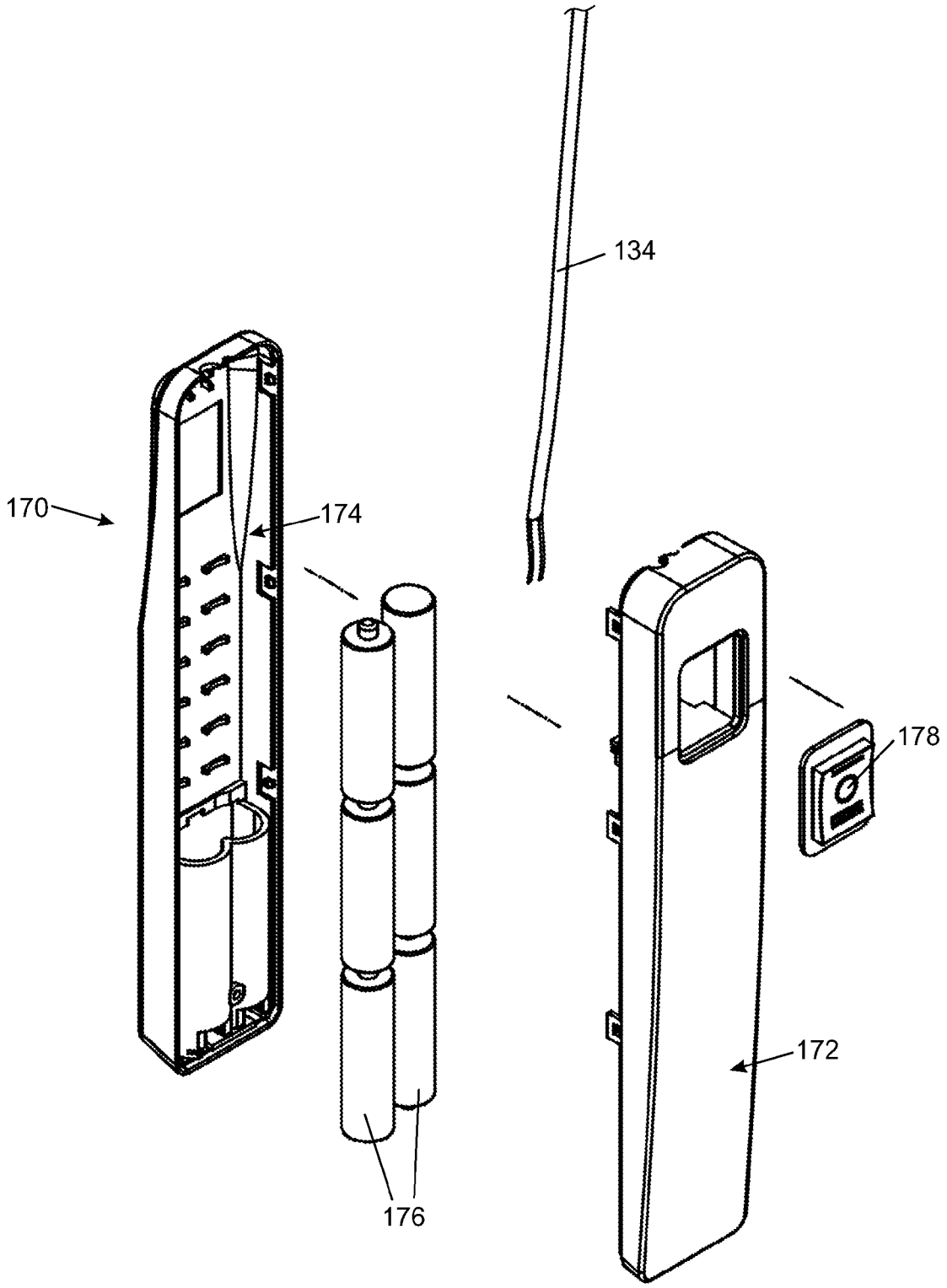
FIG. 13 is an exploded view illustrating the construction of a control interface used in the motorized window shade shown in FIG. 12.

In conjunction with FIG. 12, FIG. 13 is an exploded view illustrating the construction of the control interface 170. The control interface 170 can include a casing 172, a battery compartment 174 defined in the casing 172 where a plurality of batteries 176 can be disposed, and a control button 178. Power can be transmitted from the batteries 176 through the cable assembly 134 to the electric motor 118. In one embodiment, the control button 178 can have three state: a first state that stops the electric motor 118 for keeping the bottom part 104 at a desired position, a second state where a control signal is transmitted from the control interface 170 through the cable assembly 134 to the electric motor 118 for rotation in a direction to raise the bottom part 104, and a third state where another control signal is transmitted from the control interface 170 through the cable assembly 134 to the electric motor 118 for rotation in another direction to lower the bottom part 104.

Since the power supply is integrated in the control interface 170, access to the power supply for replacement or repair can be facilitated. For example, the lower placement of the control interface 170 can facilitate replacement of the batteries 176 used to power the electric motor 118.

Figure 14:
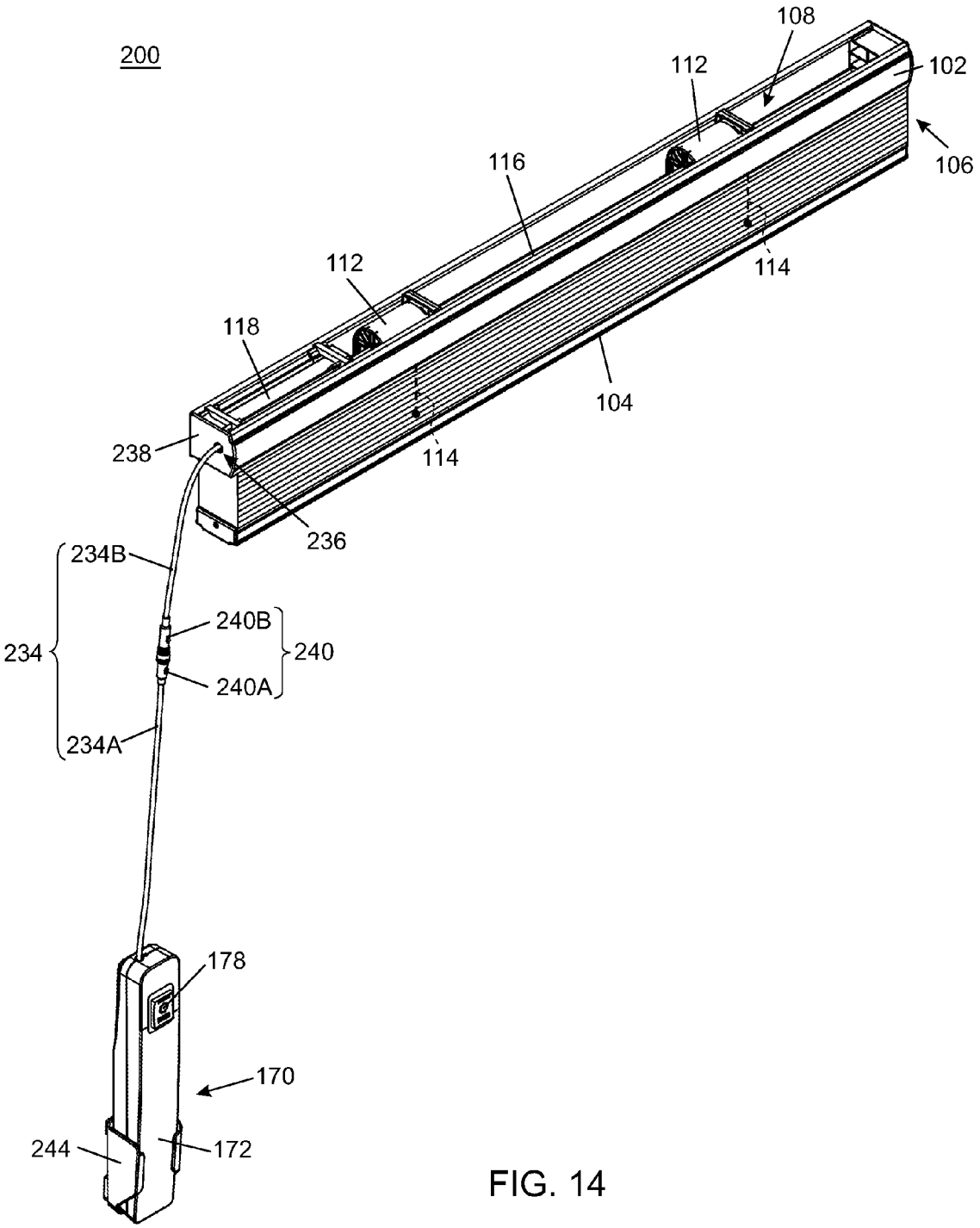
FIG. 14 is a perspective view illustrating yet another embodiment of a motorized window shade.

FIG. 14 is a schematic view illustrating another embodiment of a motorized window shade 200. Like previously described, the window shade 200 can include the head rail 102, the bottom part 104, the covering structure 106 disposed between the head rail 102 and the bottom part 104, and the motorized actuating mechanism 108 operable to raise and lower the bottom part 104 for collapsing and expanding the covering structure 106. The actuating mechanism 108 can likewise include the winding units 112, the suspension cords 114 respectively associated with the winding units 112, the rotary axle 116 and the electric motor 118. Moreover, the control interface 170 can be electrically connected with the electric motor 118 via a cable assembly 234.

In the window shade 200, no elongated tube 144 is provided. Accordingly, the cable assembly 234 can extend outside the head rail 102 through an opening 236 formed through an end cap 238 affixed with the head rail 102. The portion of the cable assembly 234 extending outside the head rail 102 can be exposed outward, and the control interface 170 can be suspended at a lower end of the cable assembly 234. In one embodiment, the portion of the cable assembly 234 extending outside the head rail 102 can include two cable segments 234A and 234B, and a connector assembly 240 through which the two cable segments 234A and 234B can be detachably connected with each other. For example, the connector assembly 240 can include a first connector 240A affixed with an end of the cable segment 234A, and a second connector 240B affixed with an end of the cable segment 234B and detachably connectable with the first connector 240A.

When the two cable segments 234A and 234B are disconnected by detaching the connectors 240A and 240B from each other, no power can be supplied from the control interface 170 to the electric motor 118. Independent storage of the control interface 170 thereby can be permitted.

When the window shade 200 is to be operated, the connectors 240A and 240B can be connected with each other so that power supply can be transmitted from the control interface 170 along the cable assembly 234 to the electric motor 118. The control interface 170 then can be operated to lower or raise the window shade 200.

For convenient placement of the control interface 170, a fixing bracket 244 may also be provided. The holding bracket 244 can be affixed on a part of a house (e.g., a wall), and the control interface 170 can be held with the holding bracket 244 at a fixed position.

The motorized window shades described herein include a control interface that is electrically connected with an actuating mechanism inside the head rail. The control interface is suspended outside the head rail, and can be conveniently accessed for operating the electric motor of the actuating mechanism.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a head rail, a bottom part suspended from the head rail, and a covering structure arranged between the head rail and the bottom part;

a winding unit arranged in the head rail and operatively connected with the bottom part, the winding unit rotating for driving a vertical displacement of the bottom part relative to the head rail;

an electric motor arranged in the head rail and operable to drive rotation of the winding unit;

a control interface electrically connected with the electric motor via a cable assembly, the control interface being operable to control rotation of the electric motor in a first direction for raising the bottom part, and in a second direction for lowering the bottom part; a substantially rigid hollow wand disposed outside the head rail, the hollow wand having a first and a second end opposite to each other, the cable assembly being routed through an interior of the hollow wand, the first end of the hollow wand being pivotally connected with the head rail, and the control interface being assembled adjacent to the second end of the hollow wand, the control interface having a housing connected with the second end of the hollow wand; and the cable assembly having a section extending between the control interface and the head rail, said section being substantially contained within the hollow wand.

2. The window shade according to claim 1, wherein the hollow wand extends vertically downward from one lateral end portion of the head rail.

3. The window shade according to claim 1, wherein the cable assembly passes through the first and second ends of the hollow wand.

4. The window shade according to claim 1, wherein the cable assembly respectively transmits control signals issued from the control interface for controlling the electric motor, and power signals for the control interface.

5. The window shade according to claim 1, wherein the cable assembly has a first terminal end connected with the control interface, and a second terminal end arranged in the head rail.

6. The window shade according to claim 5, wherein the second terminal end is connected with the electric motor.

7. The window shade according to claim 1, wherein the first end of the hollow wand is connected with the head rail via a pivotal joint, and the cable assembly passes through the pivotal joint and is routed through an interior of the head rail.

8. The window shade according to claim 7, wherein the pivotal joint includes a first joint part affixed with the first end of the hollow wand, and a second joint part that is affixed with an end cap of the head rail and is pivotally connected with the first joint part, the first and second joint parts having tubular shapes for passage of the cable assembly.

9. The window shade according to claim 1, wherein the winding unit is operatively connected with the bottom part via a suspension cord, the suspension cord having a first and a second end respectively connected with the winding unit and the bottom part.

10. The window shade according to claim 1, wherein the control interface includes one or more button operable to cause the electric motor to selectively rotate in the first or second direction.

11. The window shade according to claim 1, wherein the electric motor has an output connected with a rotary axle, and the winding unit is assembled coaxial to the rotary axle.

12. The window shade according to claim 1, wherein the electric motor is powered by a power supply incorporated in the control interface.

13. The window shade according to claim 1, wherein the hollow wand is made of a plastic material.

14. A window shade comprising:

a head rail, a bottom part suspended from the head rail, and a covering structure arranged between the head rail and the bottom part;

an actuating mechanism including an electric motor operable to drive a vertical displacement of the bottom part relative to the head rail to collapse and expand the covering structure;

a control interface electrically connected with the electric motor via a cable assembly, the control interface being operable to control rotation of the electric motor in a first direction for raising the bottom part, and in a second direction for lowering the bottom part; a substantially rigid hollow wand disposed outside the head rail, the hollow wand having a first and a second end opposite to each other, the first end of the hollow wand being connected with the head rail via a pivotal joint, the control interface being suspended at the second end of the hollow wand, and the cable assembly being routed through an interior of the hollow wand, the control interface and the hollow wand being movable in unison about the pivotal joint relative to the head rail; and the cable assembly having a section extending between the control interface and the head rail, said section being substantially contained within the hollow wand.

15. The window shade according to claim 14, wherein the hollow wand extends vertically downward from one lateral end portion of the head rail.

16. The window shade according to claim 14, wherein the cable assembly has a first terminal end connected with the control interface, and a second terminal end arranged in the head rail.

17. The window shade according to claim 14, wherein the cable assembly passes through the pivotal joint and is routed through an interior of the head rail.

18. The window shade according to claim 17, wherein the pivotal joint includes a first joint part affixed with the first end of the hollow wand, and a second joint part that is affixed with an end cap of the head rail and is pivotally connected with the first joint part, the first and second joint parts having tubular shapes for passage of the cable assembly.

19. The window shade according to claim 14, wherein the control interface includes one or more button operable to cause the electric motor to selectively rotate in the first or second direction.

20. The window shade according to claim 14, wherein the electric motor has an output connected with a rotary axle, and the actuating mechanism further includes a winding unit assembled coaxial to the rotary axle.

21. The window shade according to claim 14, wherein the electric motor is powered by a power supply incorporated in the control interface.

22. The window shade according to claim 14, wherein the cable assembly passes through the first and second ends of the hollow wand.

* * * * *